US011193735B2

(12) United States Patent
Ma et al.

(10) Patent No.: US 11,193,735 B2
(45) Date of Patent: Dec. 7, 2021

(54) QUICK DETACHING MECHANISM FOR HANDLE LIGHT

(71) Applicant: Shenzhen Olight E-Commerce Technology Co., Ltd., Guangdong (CN)

(72) Inventors: Qiang Ma, Shanxi (CN); Ziyang Zhou, Hubei (CN)

( * ) Notice: Subject to any disclaimer, the term of this patent is extended or adjusted under 35 U.S.C. 154(b) by 0 days.

(21) Appl. No.: 17/126,051

(22) Filed: Dec. 18, 2020

(65) Prior Publication Data

US 2021/0102783 A1 Apr. 8, 2021

(30) Foreign Application Priority Data

Jul. 21, 2020 (CN) ..... 202010703122.2

(51) Int. Cl.

| | |
|---|---|
| ***F41C 23/16*** | (2006.01) |
| ***F41G 11/00*** | (2006.01) |
| ***F41A 3/66*** | (2006.01) |
| ***F41G 1/35*** | (2006.01) |

(52) U.S. Cl.

CPC ..... *F41G 11/003* (2013.01); *F41A 3/66* (2013.01); *F41G 1/35* (2013.01); *F41C 23/16* (2013.01)

(58) Field of Classification Search

CPC ..... F41G 1/35; F41G 11/003; F41G 11/004; F41C 23/16

USPC ..... 42/90, 146, 124, 127, 72

See application file for complete search history.

(56) References Cited

U.S. PATENT DOCUMENTS

| | | | | |
|---|---|---|---|---|
| 7,685,761 | B2 * | 3/2010 | Wu | F41G 1/35 42/146 |
| 8,109,032 | B2 * | 2/2012 | Faifer | G03B 17/563 42/146 |
| 8,973,296 | B1 * | 3/2015 | Kocmich, IV | F41A 23/02 42/90 |
| 11,054,222 | B2 * | 7/2021 | Duffner | F41G 11/003 |
| 2011/0047851 | A1 * | 3/2011 | Mock | F41G 1/35 42/72 |
| 2017/0045334 | A1 * | 2/2017 | Yim | F16M 13/02 |

* cited by examiner

*Primary Examiner* — Reginald S Tillman, Jr.

(74) *Attorney, Agent, or Firm* — Prakash Nama; Global IP Services, PLLC

(57) ABSTRACT

This invention provides a quick detaching mechanism for handle light, including a handle light, a base and a locking rod; the base is rotatably connected to the locking rod; the locking rod detachably mounts the handle light on a bottom of the base; the base has a top which is mounted on a firearm rail. Through the cooperation of the base and the locking rod, the handle light with the handle and the tactical light combined can be quickly mounted on and detached from the firearm rail. The mounting and detachment processes can be completed by only controlling the locking rod. It is convenient to use and no other tools is required. Its operation is simple and convenient.

10 Claims, 8 Drawing Sheets

QUICK DETACHING MECHANISM FOR HANDLE LIGHT

BACKGROUND OF THE INVENTION

The present invention relates to the technical field of tactical lights, and more specifically relates to a quick detaching mechanism for handle light.

In the market of tactical lights for long firearms, many firearms require additional firearm rails to mount firearm accessories. Firearm accessories are often mounted below or on the side of the firearm rail. Generally, a handle is also required to be mounted for easy holding and maintaining shooting stability. It is also necessary to mount a tactical light as a firearm accessory for auxiliary lighting.

Common firearm handles and tactical lights are two separate firearm accessories. The handle and the tactical light need to be detached and mounted separately. The handle light in the prior art combines the handle and the tactical light, but when using the handle light, one often needs tools to detach or mount the handle light, resulting in inconvenient operation and use.

BRIEF SUMMARY OF THE INVENTION

In view of the aforesaid disadvantages now present in the prior art, the present invention provides a quick detaching mechanism for handle light which achieves quick mounting and detachment of the handle light which combines a handle and a tactical light. The operation is simple, quick and convenient.

The present invention provides the following technical solutions:

A quick detaching mechanism for handle light, comprising a handle light, a base and a locking rod; the base is rotatably connected to the locking rod; the locking rod detachably mounts the handle light on a bottom of the base; the base has a top which is mounted on a firearm rail.

Preferably, the base is connected to a movable lock block; the movable lock block cooperates with the base to clamp the firearm rail.

Furthermore, the base is connected to a screw; the base is connected to the movable lock block via the screw; the screw has a first end which is connected to the base and a second end which is connected to the movable lock block.

Furthermore, the screw is mounted on the top of the base; the screw is located in a slot of the firearm rail.

Preferably, the locking rod is located on a side of the base; the locking rod is connected to a rotating shaft; the locking rod is connected to the base through the rotating shaft.

Furthermore, the handle light has a top which is provided with a handle light slot; the locking rod comprises a snapping member and a pressing member; the snapping member and the handle light slot engage with each other to lock the handle light in place; the pressing member and the snapping member are respectively disposed on two sides of the rotating shaft; the pressing member is used for disengaging the snapping member from the handle light slot.

Furthermore, the base is further connected with a first elastic member; the first elastic member has a first end which abuts against an interior of the base and a second end which abuts against the pressing member.

Furthermore, the base is provided with a ball latch at an interior thereof; the ball latch cooperates with the snapping member to clamp the handle light.

Furthermore, the bottom of the base is provided with a sliding slot; the snapping member is located at an inner side of the sliding slot; the top of the handle light is inserted into the base along the sliding slot.

Furthermore, an end face of the snapping member that abuts against the handle light slot is disposed with a knurled texture.

The present invention has the following beneficial advantages: The present invention provides a quick detaching mechanism for handle light. Through the cooperation of the base and the locking rod, the handle light with the handle and the tactical light combined can be quickly mounted on and detached from the firearm rail. It is only required to control the locking rod to complete the mounting and detachment processes. It is convenient to use and no other tools is required. Its operation is simple and convenient. The cooperation of the movable lock block and the screw can further increase the clamping force of the base to the firearm rail, as well as limit the base in all directions so that it is difficult to get loosened from the firearm rail. The locking rod is provided with a snapping member and a pressing member. The locking rod is connected to the base through a rotating shaft. The engagement and disengagement of the snapping member and the handle light slot of the handle light is controlled by controlling the pressing member by lever principle, thereby achieving mounting and detachment of the handle light.

Figure 1:
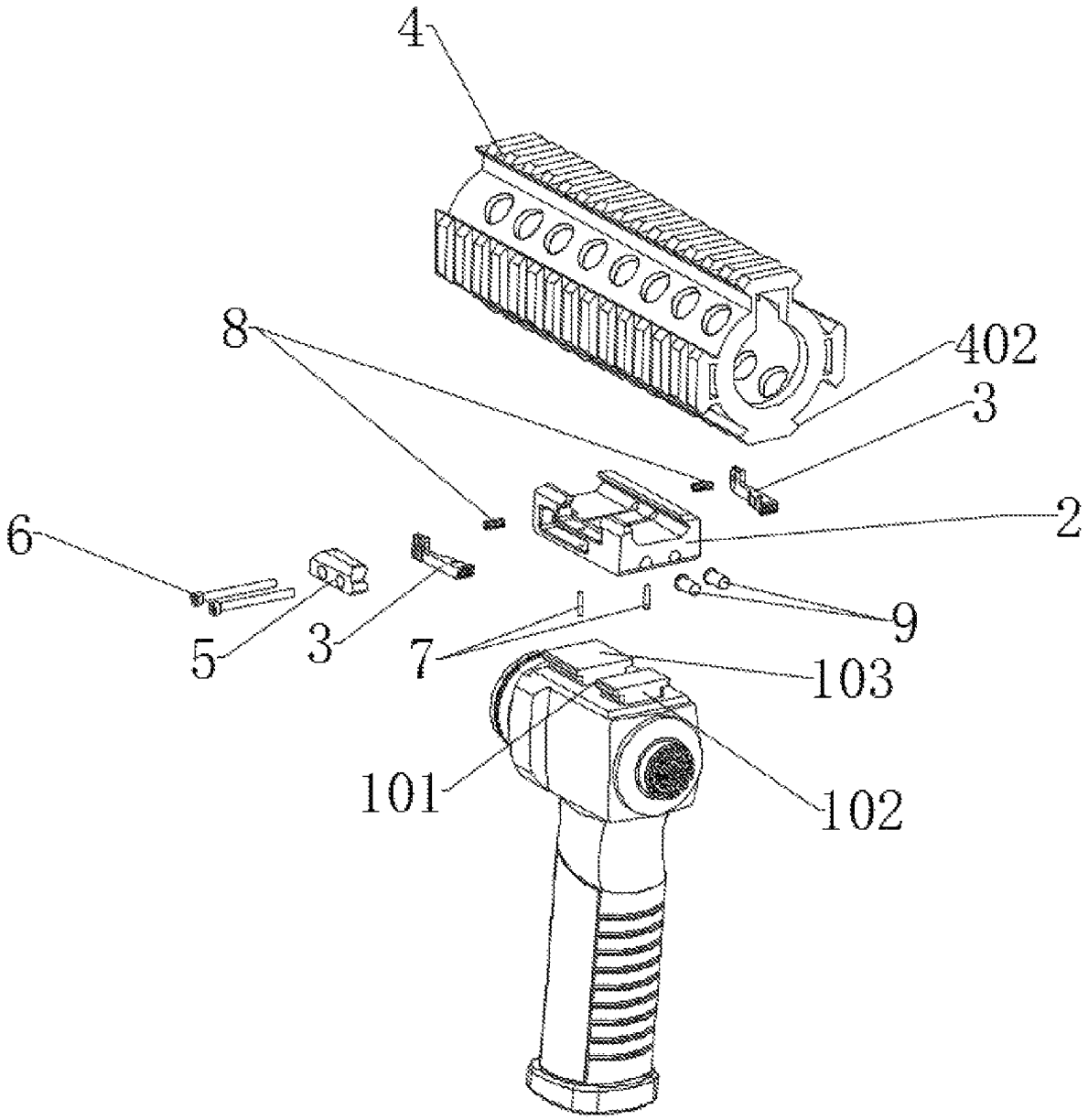
FIG. 1 is an exploded structural view of the quick detaching mechanism for handle light.

References in the figures: 1—handle light; 101—handle light slot; 102—first T-shaped block; 103—second T-shaped block; 2—base; 201—mounting slot; 201*a*—V-shaped rail; 202—sliding slot; 203—notch; 3—locking rod; 301—pressing member; 302—snapping member; 4—firearm rail; 401—slot; 402—V-shaped protrusion; 5—moving lock block; 501—V-shaped slot; 6—screw; 7—rotating shaft; 8—first elastic member; 9—ball latch.

DETAILED DESCRIPTION OF THE INVENTION

Some embodiments of the present invention are further described in detail below. The embodiments are illustrated in the figures. Identical or like references throughout the description and the figures represent identical or like components or components having the same or similar functions. The embodiments described below with reference to the figures should be considered illustrative for the purpose of explaining the technical features of the present invention, and should not be considered as any limitation to the present invention.

In the present invention, it should be noted that directions or positional relationships indicated by terms such as "length", "width", "upper", "lower", "front", "rear", "left", "right", "vertical", "horizontal", "top", "bottom" should be understood based on the directions or positional relationships according to the figures, and should also be understood as merely means for simplification for the sake of easier illustration of the present invention. It is not meant or intended to mean that the devices or components concerned should have such specifically described directions, or should be configured or operated according to the specifically described directions, and hence should not be considered as any limitation to the present invention.

Further, terms like "first", "second" are used for illustrative purpose, and should not be understood as meaning or implying relative importance or as a subtle indication of a quantity of the described technical feature. Therefore, a feature defined by "first" or "second" may comprises by obvious indication or subtle implication, one or more than one of said feature in terms of quantity. In the description, "a plurality of" means a quantity of two or above, unless otherwise specified.

In the present invention, unless otherwise specified, terms such as "install", "connect", "communicate" and "fix" should be understood broadly. For example, a fixed connection, a removable connection, or integral formation may be intended. Further, connection may be mechanical or electrical, direct or indirect through a medium, and may be an internal communication between two components or an interactive relationship between two components. A person skilled in this field of art should be able to understand the specific meaning of the terms described in the present invention according to the context of the practical situation described.

The firearm rails mentioned in this application are all Picatinny rails in the prior art. The rail is formed by a line of ribs, and the gap between two adjacent ribs forms a slot 401.

FIGS. 1 to 10 show a specific embodiment of a quick detaching mechanism for handle light. The quick detaching mechanism for handle light comprises a handle light 1, a base 2 and locking rods 3.

Figure 9:
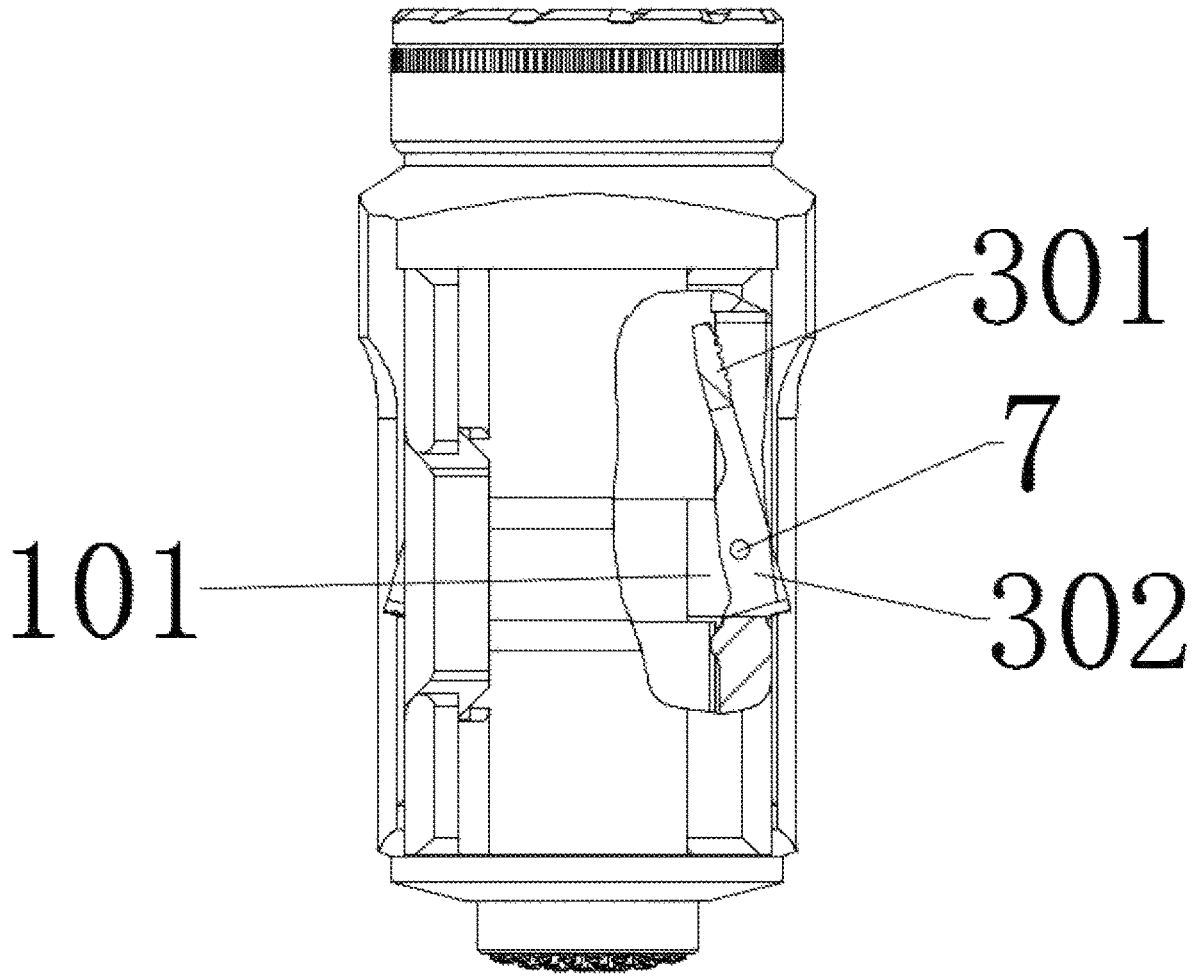
FIG. 9 is a partial sectional view of the quick detaching mechanism for handle light in a state where the locking rod is disengaged from the handle light slot.

As shown in FIGS. 1 and 9, the handle light 1 is a combination of a handle and a tactical light. By combining the tactical light and the handle, one can reduce the number of accessories mounted on the firearm rail 4. In comparison with the prior art in which the handle and the tactical light are separately mounted, the handle light 1 only needs to mount the handle light 1 as one accessory to achieve two auxiliary functions, thereby reducing the volume of the firearm and lowering the burden of the firearm.

The base 2 is rotatably connected to the locking rods 3. The locking rods 3 detachably mount the handle light 1 on a bottom of the base 2. The base 2 has a top which is connected to a firearm rail 4. Specifically, the base 2 may be pre-mounted on the firearm rail 4. The base 2 cooperates with the locking rods 3 to mount the handle light 1 on the base 2, thereby enabling the handle light 1 to be quickly mounted on and detached from the firearm rail 4.

As shown in FIGS. 1 to 4 and 7, in this embodiment, the base 2 is provided with a movable lock block 5. The movable lock block 5 cooperates with the base 2 to clamp the firearm rail 4. In this embodiment, the base 2 is mounted on a rail on one side of the firearm rail 4. Two sides of the rail protrude outwards to form V-shaped protrusions 402. The base 2 has a top which is provided with a mounting slot 201. The mounting slot 201 has a first side surface which is recessed inwards to form a V-shaped rail 201*a*. The V-shaped rail 201*a* fits the V-shaped protrusions 402. The mounting slot 201 has a second side surface which is provided with a notch 203. The movable lock block 5 is located in the notch 203. One side of the movable lock block 5 is provided with a V-shaped slot 501 which fits the V-shaped protrusions 402 of the firearm rail 4. Specifically, the movable lock block 5 and the first side surface of the mounting slot 201 cooperates to provide clamping force to clamp the top of the base 2 on the rail on one side of the firearm rail 4. When the movable lock block 5 is loosened from the base 2, the base 2 can be detached from the firearm rail 4.

Figure 8:
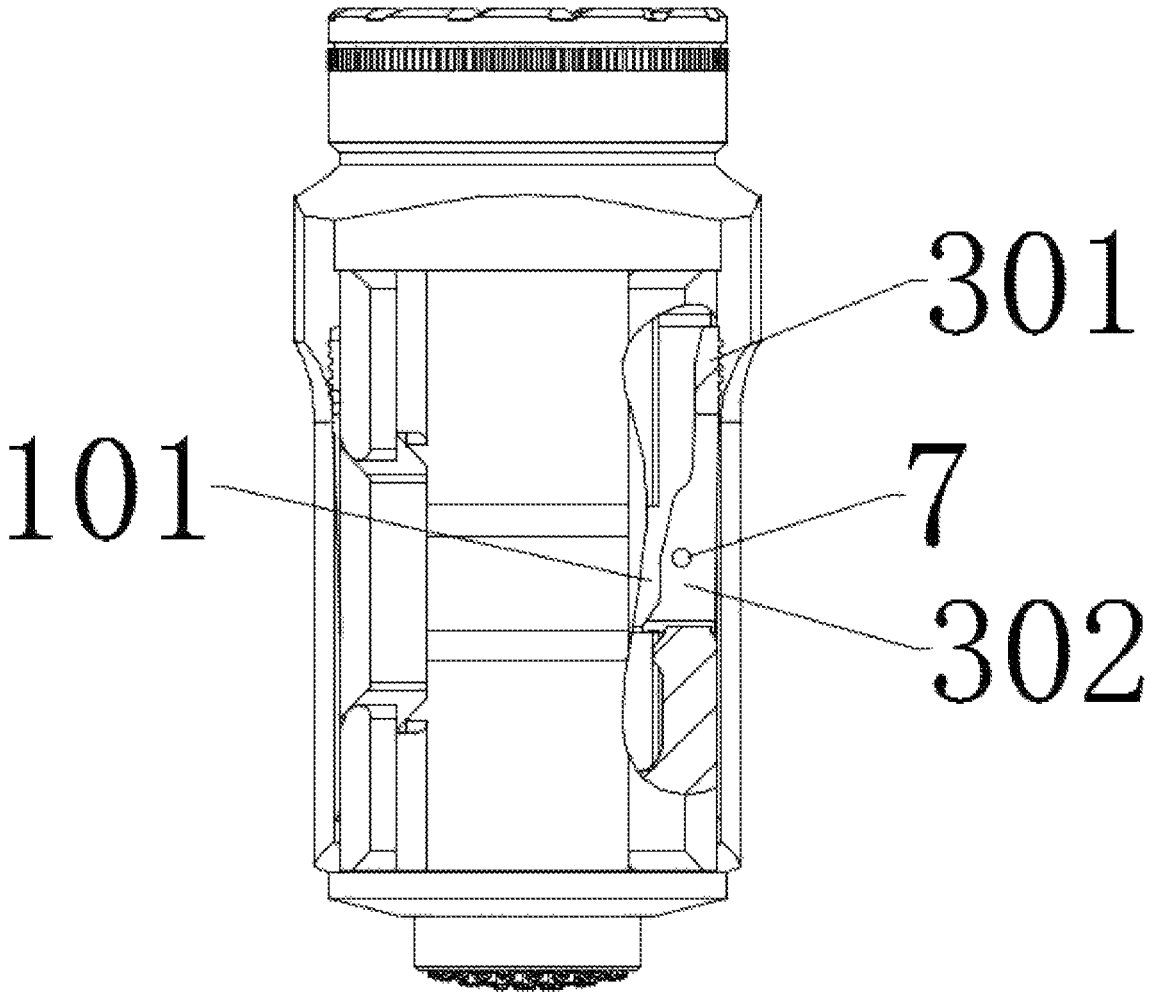
FIG. 8 is a partial sectional view of the quick detaching mechanism for handle light in a state where the locking rod is engaged in the handle light slot for locking the handle light in place.

As shown in FIGS. 1 and 8 to 9, in this embodiment, the base 2 is provided with screws 6. The base 2 is connected to the movable lock block 5 through the screws 6. Each of the screws 6 has a first end which is connected to the base 2 and a second end which is connected to the movable lock block. The first end of each of the screws 6 passes through a first inner side of the mounting slot 201. The second end of the screw 6 passes through the movable lock block. The movable lock block 5 and the base 2 are fixedly connected by tightening the screws 6. Specifically, the firearm rail 4 is first snapped on the top of the base 2, and the screws 6 are then tightened to shorten the distance between the movable lock block 5 and the first inner side of the mounting slot 201, thereby forming a clamping force to the firearm rail 4 to limit the degree of freedom of the base 2 relative to the firearm rail 4 in the up-down and left-right directions; therefore, the base 2 would not be detached from the firearm rail 4, nor would it jiggle.

As shown in FIG. 1, in this embodiment, the screws 6 are mounted on the top of the base 2. The screws 6 are located in the slots 401 of the firearm rail 4. Specifically, the screws 6 are located on the mounting slot 201. Each of the screws 6 has a cross-section having a diameter smaller than the width of the slot 401 of the firearm rail 4, so that the exposed rod portion of the screw 6 can enter the slot 401 of the firearm rail 4 for limiting the degree of freedom of the base 2 relative to the firearm rail 4 in the front-rear direction, and thus the base 2 could not move forwards and backwards along the firearm rail 4.

In this embodiment, the screws 6 are stuck in the slots 401 of the firearm rail 4 to limit the front-rear degree of freedom of the base 2. However, in other embodiments, the clamping force of the movable lock block 5 and the base 2 may be raised to increase the friction resistance among the base 2, the movable lock block 5 and the firearm rail 4 to limit the front-rear degree of freedom.

Furthermore, the firearm rail 4 is slid along the mounting slot 201 to insert into the top of the base 2, then the first end of each of the screws 6 sequentially passes through the movable lock block 5 and the slot 401 of the firearm rail 4 to reach the first side surface of the mounting slot 201 and connects with the first side surface of the mounting slot 201, and finally the screws 6 are tightened to complete the mounting of the base 2.

Specifically, before mounting the handle light 1, the base 2, the movable lock block 5 and the screws 6 cooperate to mount on the firearm rail 4, and the screws 6 are then tightened for fixation. When the handle light 1 needs to be mounted, mount the handle light 1 directly on the bottom of the base 2 to achieve quick attaching.

In this embodiment, there are two screws 6, and at least one rail rib is located between the screws 6 to further improve the stability of the base 2. Obviously, in other embodiments, there might be one or more screws 6.

In some embodiments, the base 2 can also be mounted on the firearm rail 4 via the mounting slot 201 and fixed by the screws 6. Specifically, the firearm rail 4 can slide along the mounting slot 201 to insert into the top of the base 2. The screws 6 pass through the slot 401 of the firearm rail 4 from the first side surface of the mounting slot 201, and then pass through the second side surface of the mounting slot 201. The screws 6 are then tightened to closely fasten the mounting slot 201 with the firearm rail 4. The screws 6 are stuck in the slots 401 to prevent the base 2 from sliding forwards and backwards.

As shown in FIGS. 1 to 2 and FIGS. 8 to 9, in this embodiment, there are two locking rods 3. The locking rods 3 are located on the sides of the base 2. The locking rods 3 are respectively provided on two sides of the base 2. The locking rods 3 are each connected with a rotating shaft 7. The locking rods 3 are connected to the base 2 through the rotating shafts 7 respectively. The locking rods 3 can be rotated around the rotating shafts 7 respectively.

In other embodiments, there can be one locking rod 3, and the locking rod 3 is located on one of the sides of the base 2.

As shown in FIGS. 1, 8 to 9, the handle light 1 has a top which is provided with a handle light slot 101. Each of the locking rods 3 comprises a snapping member 302 and a pressing member 301. The snapping member 302 and the handle light slot 101 are correspondingly disposed to lock the handle light 1 on the base 2. The pressing member 301 and the snapping member 302 are respectively disposed on two sides of the rotating shaft 7. The pressing member 301 is used to disengage the snapping member 302 from the handle light slot 101. In this embodiment, the pressing member 301 is used to control the engagement and disengagement between the snapping member 302 and the handle light slot 101. Specifically, when the pressing member 301 is moved inwards towards the base 2 by a pressing force, the snapping member 302 is moved outwards by lever principle until reaching a positon as shown in FIG. 9 where the snapping member 302 is completely disengaged from the handle light slot 101 so that the handle light 1 can be detached, thereby achieving quick detaching of the handle light 1 by pressing the pressing member 301.

Figure 10:
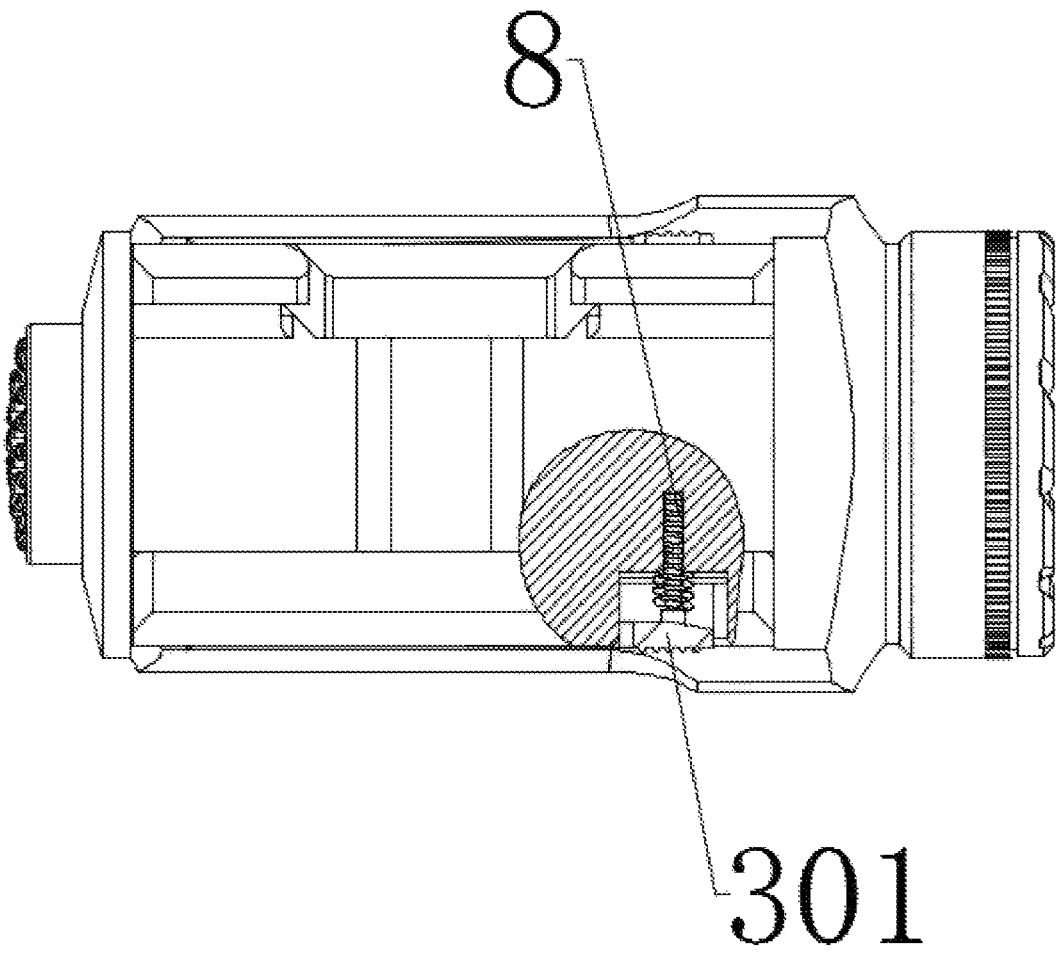
FIG. 10 is another partial sectional view of the quick detaching mechanism for handle light.

As shown in FIGS. 1 and 10, the base 2 is further provided with first elastic members 8. Each of the first elastic members 8 has a first end which abuts against an interior of the base 2 and a second end which abuts against the pressing member 301. When the pressing members 301 are pressed, each of the first elastic members 8 is compressed by force; when the pressing members 301 are released, the pressing members 301 are pushed outwards under pushing force of the first elastic members 8. At the same time, the snapping members 302 move towards the base 2 to snap fit in the handle light slot 101. Specifically, the quantity of the first elastic members 8 is equal to that of the locking rods 3. In this embodiment, the first elastic members 8 are springs. In other embodiments, the first elastic members 8 may also be spring plates or flexible blocks.

The base 2 is provided with ball latches 9. The ball latches 9 cooperate with the snapping members 302 to clamp the handle light 1. The top of the handle light 1 is provided with a first T-shaped block 102 and a second T-shaped block 103. The handle light slot 101 is located between the first T-shaped block 102 and the second T-shaped block 103. The snapping members 302 snap fit in the handle light slot. Each of the ball latches 9 abuts against a first end face of the first T-shaped block 102 to apply pressure to the first T-shaped block 102. The first end face and a second end face which are located at front and rear ends of the first T-shaped block 102 respectively abut against the ball latches 9 and the snapping members 302, thereby further improving the stability of the handle light 1 being mounted on the base 2. In this embodiment, each of the ball latches 9 comprises a steel ball, a second elastic member and a shell. In this embodiment, the second elastic member is a spring.

The bottom of the base 2 is provided with a sliding slot 202. The snapping member 302 is located at an inner side of the sliding slot 202. The top of the handle light 1 is inserted into the base 2 along the sliding slot 202. Specifically, the first T-shaped block 102 and the second T-shaped block 103 on the top of the handle light 1 are inserted into the base 2 along the sliding slot 202, and the snapping members 302 snap fit in the handle light slot 101, thereby completing the mounting of the handle light 1. In some embodiments, the pressing members 301 are pressed and simultaneously the handle light 1 is inserted along the sliding slot 202 until the snapping members 302 reach the positions of the handle light slot 101, then the pressing members 301 are released so that the snapping members 302 snap fit in the handle light slot 101. During the sliding process, it is also possible to determine whether the snapping members 302 are in place by the abutment of the first T-shaped block 102 against the ball latches 9. Specifically, when the first end surface of the first T-shaped block 102 abuts against the ball latches 9, the ball latches 9 apply pressure to the handle to provide the user with a sense of reaching the right positions. When the user feels the pressure of ball latches 9, it means that the snapping members 302 correspond to the positions of the handle light slot 101 at this time, and the user can release the pressing members 301 to allow the snapping members 302 to snap fit in the handle light slot 101.

As shown in FIGS. 1 to 2 and FIGS. 8 to 9, in this embodiment, the snapping members 302 each has a slope structure. When the handle light 1 slides along the sliding slot 202, the first T-shaped block 102 slides in along the slope structures. The slope structures are therefore pushed by the first T-shaped block 102, and the pressing members 301 are driven to move towards the inner side of the base 2 by lever principle. The first elastic members 8 are pressed until the snapping members 302 snap fit in the handle light slot 101. By providing the snapping members 302 with the slope structures, it is not necessary to press the pressing members 301 all the time when mounting the handle light 1; it is only required to slide it along the sliding slot 202 to complete the mounting. When it is required to be detached, press the pressing members 301 and then slide it out along the sliding slot 202 in the opposite direction to achieve detachment. The operation is simple and convenient.

Figure 2:
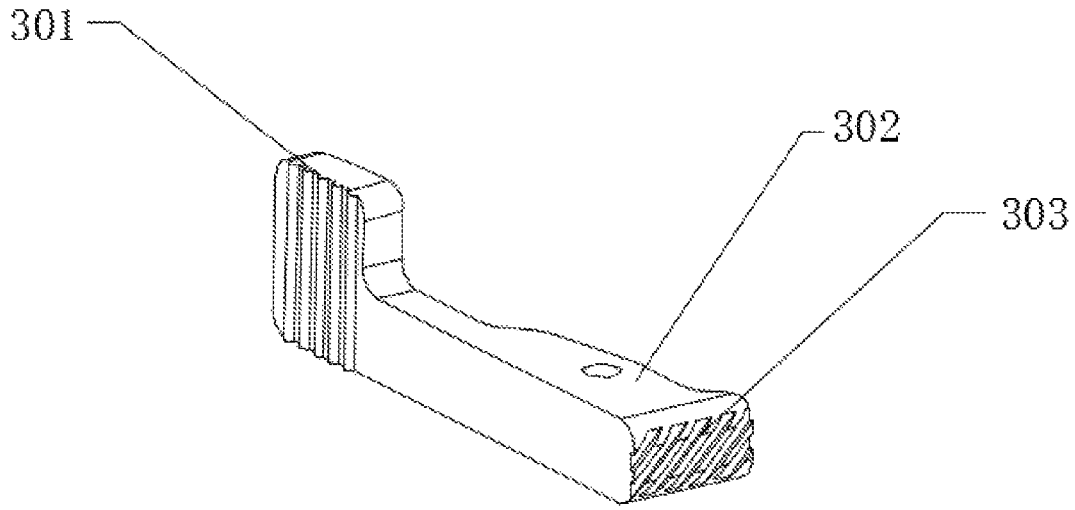
FIG. 2 is a schematic structural view of the locking rod.
Figure 3:
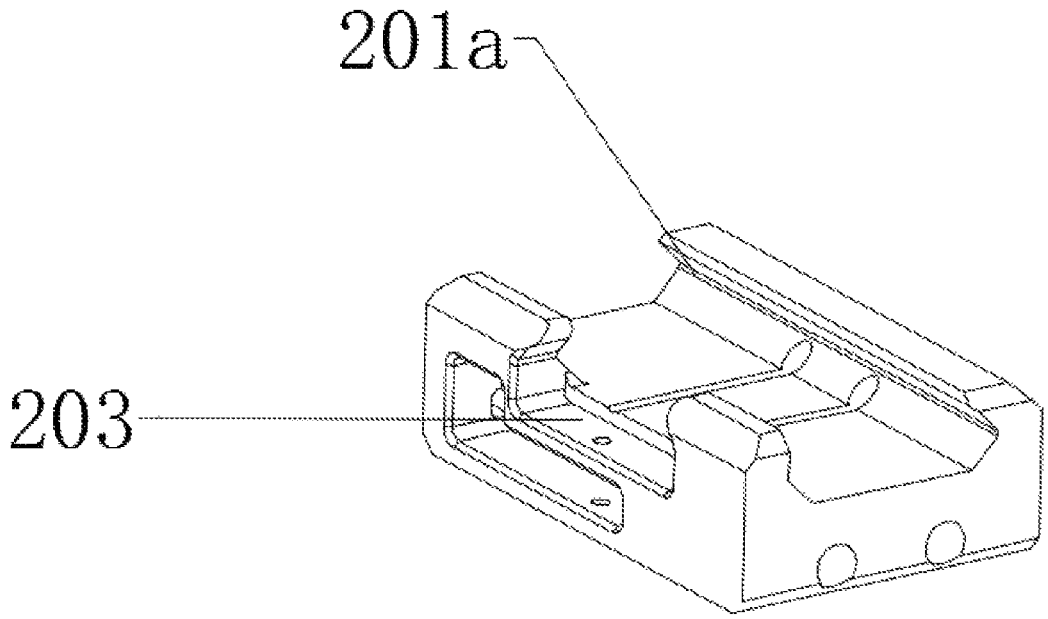
FIG. 3 is a schematic structural view of the base.
Figure 4:
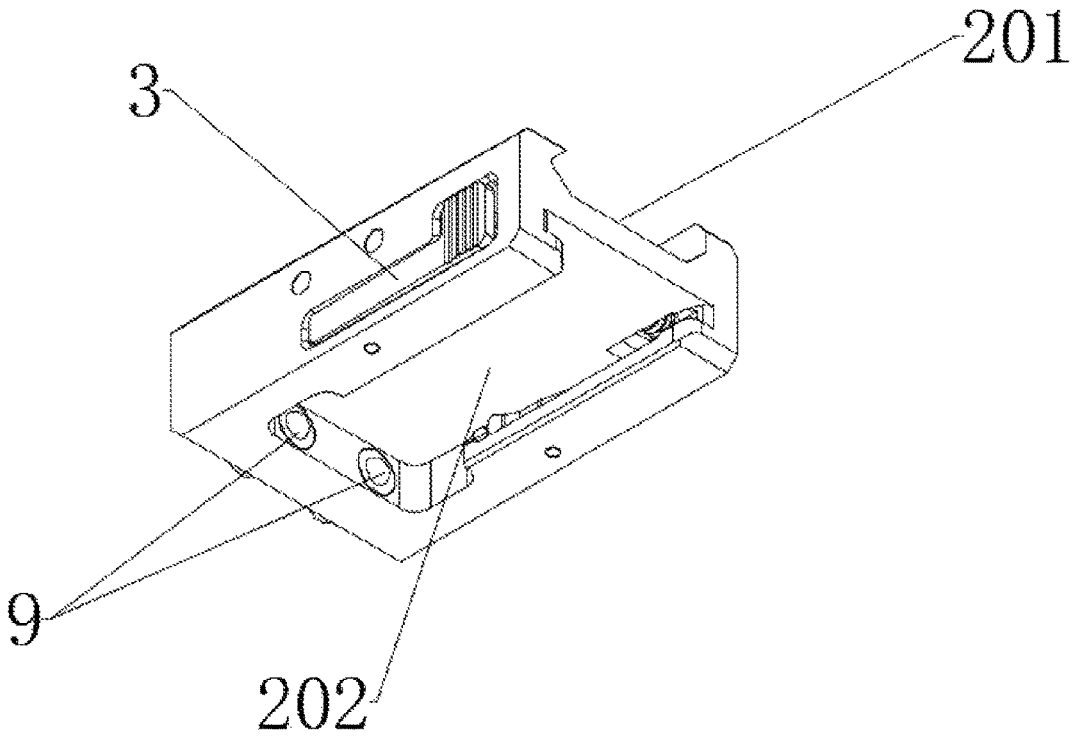
FIG. 4 is a bottom view of the base in a state when the base and the locking rod are assembled.
Figure 5:
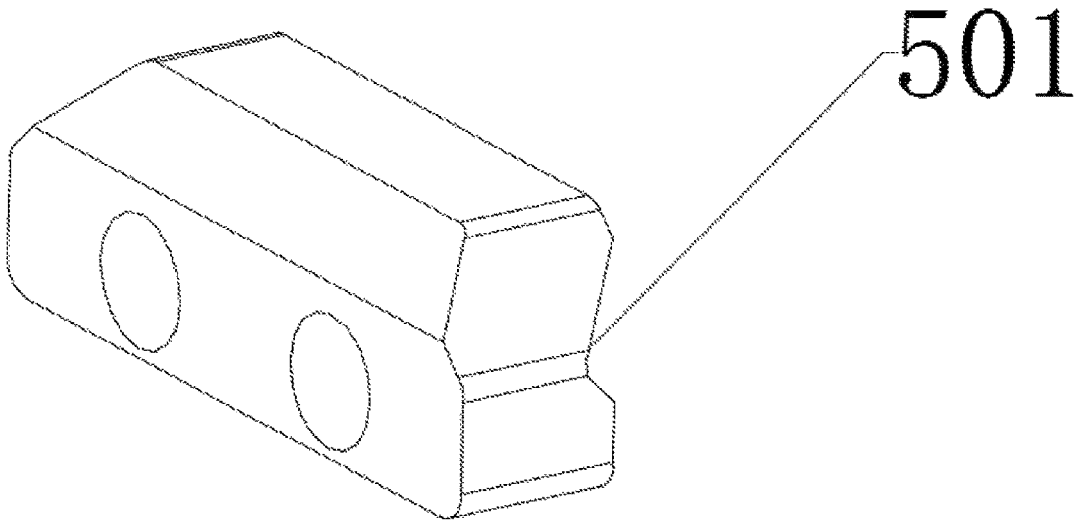
FIG. 5 is a schematic structural view of the movable lock block.
Figure 6:
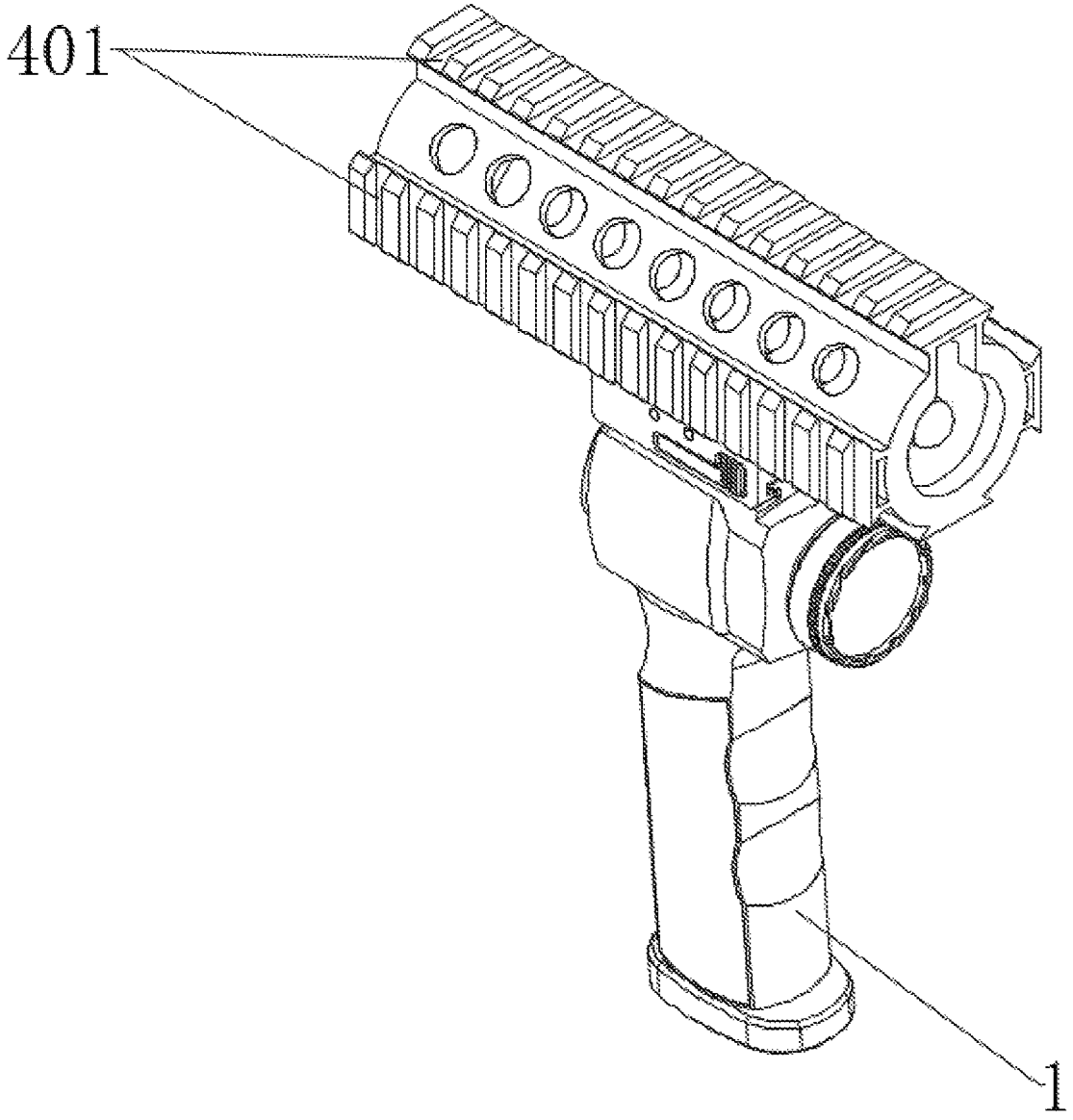
FIG. 6 is a schematic perspective structural view of the quick detaching mechanism for handle light.
Figure 7:
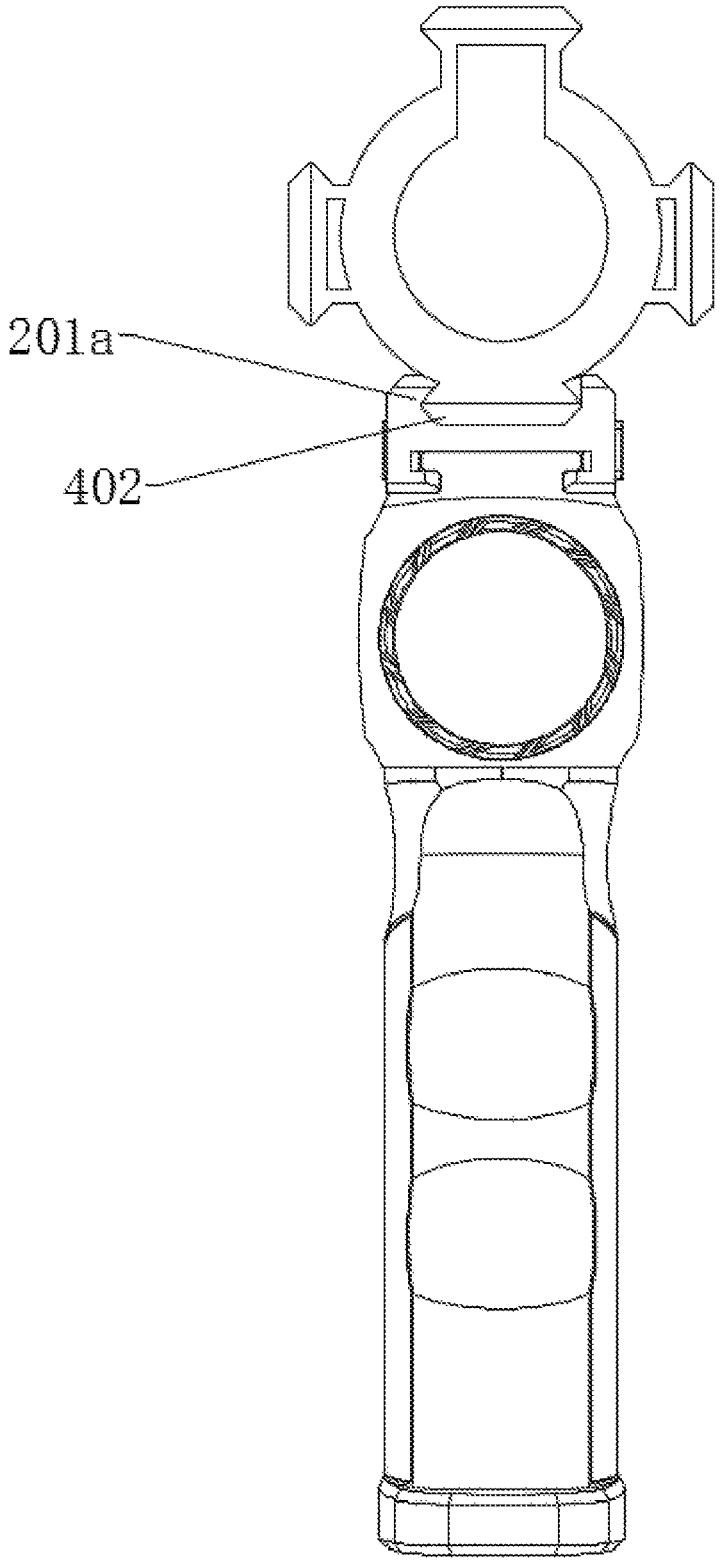
FIG. 7 is a schematic front structural view of the quick detaching mechanism for handle light.

As shown in FIG. 2, in this embodiment, the end face of each of the snapping members 302 that abuts against the handle light slot 101 is disposed with a knurled texture for increasing the friction between the snapping member 302 and the handle light slot to improve mounting stability.

The present invention is described in details with reference to specific embodiments.

Embodiment 1: A quick detaching mechanism for handle light comprises a handle light 1, a base 2 and a locking rod 3. The base 2 has a top which is provided with a mounting slot 201. The firearm rail 4 slides along the mounting slot 201 to insert into the top of the base 2, and is fixed by cooperation of a movable lock block 5 and a screw 6. The locking rod 3 is located on one side of the base 2 and is connected to the base 2 via a rotating shaft 7. The locking rod 3 comprises a snapping member 302 and a pressing member 301. The snapping member 302 and the pressing member 301 are respectively disposed on two sides of the rotating shaft 7. The top of the handle light 1 is provided with a first T-shaped block 102 and a second T-shaped block 103. A handle light slot 101 is located between the first T-shaped block 102 and the second T-shaped block 103. The bottom of the base 2 is provided with a sliding slot 202. The first T-shaped block 102 and the second T-shaped block 103 are inserted into the base 2 by sliding along the sliding slot 202. The movement of the snapping member 302 can be controlled by controlling the pressing member 301. The base 2 is provided with a ball latch 9. When the snapping member 302 reaches the position of the handle light slot 101, the ball latch 9 abuts against a first end face of the first T-shaped block 102. At this time, the pressing member 301 can be released to allow the snapping member 302 to snap fit in the handle light slot 101.

Embodiment 2: A quick detaching mechanism for handle light comprises a handle light 1, a base 2 and two locking rods 3. The base 2 has a top which is provided with a mounting slot 201. The firearm rail 4 slides along the mounting slot 201 to insert into the top of the base 2. The top of the base 2 is mounted on the firearm rail 4 via a screw 6. The screw 6 is used to limit the degree of freedom of the base 2 in the front-rear direction. The locking rods 3 are respectively located on two sides of the base 2. Each of the locking rods 3 is provided with a snapping member 302 and a pressing member 301. The snapping member 302 and the pressing member 301 are respectively disposed on two sides of the rotating shaft 7. The top of the handle light 1 is provided with a first T-shaped block 102 and a second T-shaped block 103. A handle light slot 101 is located between the first T-shaped block 102 and the second T-shaped block 103. Each of the snapping members 302 has a slope structure. The bottom of the base 2 is provided with a sliding slot 202. The first T-shaped block 102 and the second T-shaped block 103 slide along the sliding slot 202 to insert into the base 2 until the snapping members 302 are completely inserted in the handle light slot 101, and the snapping members 302 automatically snap fit in the handle light slot 101.

In summary, the present invention provides a quick detaching mechanism for handle light. Through the cooperation of the base and the locking rod, the handle light with the handle and the tactical light combined can be quickly mounted on and detached from the firearm rail. It is only required to control the locking rod to complete the mounting and detachment processes, which is convenient to use. The cooperation of the movable lock block 5 and the screw can further increase the clamping force of the base to the firearm rail, as well as limit the base in all directions so that it is difficult to get loosened from the firearm rail. The locking rod is provided with a snapping member and a pressing member. The locking rod is connected to the base through a rotating shaft. The engagement and disengagement of the snapping member and the handle light slot of the handle light are controlled by lever principle, thereby achieving mounting and detachment of the handle light. The snapping member has a slope structure. When the handle light is inserted into the base along the sliding slot, the snapping member automatically snap fits with the handle light slot, so that the mounting of the handle light can be done in one step.

The above embodiments are only some of the preferred embodiments of the present invention. General changes or replacements made by a person skilled in this field of art in accordance with the scope of teachings of the present invention should also fall within the scope of protection of the present invention.

What is claimed is:

1. A quick detaching mechanism for handle light, comprising a handle light (1), a base (2) and a locking rod (3); the base (2) is rotatably connected to the locking rod (3); the locking rod (3) detachably mounts the handle light (1) on a bottom of the base (2); the base (2) has a top which is mounted on a firearm rail (4).

2. The quick detaching mechanism for handle light as in claim 1, wherein the base (2) is connected to a movable lock block (5); the movable lock block (5) cooperates with the base (2) to clamp the firearm rail (4).

3. The quick detaching mechanism for handle light as in claim 2, wherein the base (2) is connected to a screw (6); the base (2) is connected to the movable lock block (3) via the screw (6); the screw (6) has a first end which is connected to the base (2) and a second end which is connected to the movable lock block (5).

4. The quick detaching mechanism for handle light as in claim 3, wherein the screw (6) is mounted on the top of the base (2); the screw (6) is located in a slot (401) of the firearm rail (4).

5. The quick detaching mechanism for handle light as in claim 1, wherein the locking rod (3) is located on a side of the base (2); the locking rod (3) is connected to a rotating shaft (7); the locking rod (3) is connected to the base (2) through the rotating shaft (7).

6. The quick detaching mechanism for handle light as in claim 5, wherein the handle light (1) has a top which is provided with a handle light slot (101); the locking rod comprises a snapping member (302) and a pressing member (301); the snapping member (302) and the handle light slot (101) engage with each other to lock the handle light (1) in place; the pressing member (301) and the snapping member (302) are respectively disposed on two sides of the rotating shaft (7); the pressing member (301) is used for disengaging the snapping member (302) from the handle light slot (101).

7. The quick detaching mechanism for handle light as in claim 6, wherein the base (2) is further connected with a first elastic member (8); the first elastic member (8) has a first end which abuts against an interior of the base (2) and a second end which abuts against the pressing member (301).

8. The quick detaching mechanism for handle light as in claim 6, wherein the base (2) is provided with a ball latch (9) at an interior thereof; the ball latch (9) cooperates with the snapping member (302) to clamp the handle light.

9. The quick detaching mechanism for handle light as in claim 6, wherein the bottom of the base (2) is provided with a sliding slot (202); the snapping member (302) is located at an inner side of the sliding slot (202); the top of the handle light (1) is inserted into the base (2) along the sliding slot (202).

10. The quick detaching mechanism for handle light as in claim 6, wherein an end face of the snapping member (302) that abuts against the handle light slot (101) is disposed with a knurled texture.

* * * * *